United States Patent [19]

Coldren

[11] 4,432,459

[45] Feb. 21, 1984

[54] TACK BOX AND SADDLE RACK UNIT

[76] Inventor: Margaret E. Coldren, R.D. #1, Abbottstown, Pa. 17301

[21] Appl. No.: 241,423

[22] Filed: Mar. 6, 1981

[51] Int. Cl.[3] ..... A47F 7/00

[52] U.S. Cl. ..... 211/13; D34/44; 206/557; 294/144; 312/DIG. 33

[58] Field of Search ..... 211/13; 206/372, 373, 206/374, 375, 557; 294/144, 172, 137; 312/DIG. 33; D34/44; D3/30.1, 30.5

[56] References Cited

U.S. PATENT DOCUMENTS

| | | | |
|---|---|---|---|
| D. 134,185 | 10/1942 | Belshaw | D34/44 |
| D. 142,272 | 8/1945 | Dernehl | D34/44 |
| D. 184,605 | 3/1959 | Cooper | D3/305 |
| D. 194,515 | 2/1963 | Dawson | D34/44 |
| 1,404,266 | 1/1922 | Brouner . | |
| 2,592,212 | 4/1952 | Turner . | |
| 2,727,543 | 12/1955 | Polselli . | |
| 2,740,517 | 4/1956 | Evans | 206/373 |
| 2,809,755 | 10/1957 | Martorello . | |
| 3,688,912 | 9/1972 | Wilmoth . | |
| 3,780,971 | 12/1973 | De Filipps . | |
| 4,122,944 | 10/1978 | De Napoli . | |

*Primary Examiner*—Ramon S. Britts
*Assistant Examiner*—Robert W. Gibson, Jr.
*Attorney, Agent, or Firm*—C. Hercus Just

[57] ABSTRACT

A tack box and saddle rack comprising a lower rectangular box portion including side panels fastened to end members which extend above the top edges of the side panels and including rails extending between said end members in an area above said top edges of said side panels, one of said rails being uppermost and centrally between the side edges of said end members and two side additional rails respectively being in a common horizontal plane below said uppermost rail and respectively spaced a short distance inward from said side edges of said end members to support a saddle upon said central uppermost rail and the depending stirrups hanging outwardly of said two side rails but contained in said box portion with other accouterments, such as bridle, girth, saddle dressing and the like.

1 Claim, 6 Drawing Figures

TACK BOX AND SADDLE RACK UNIT

BACKGROUND OF THE INVENTION

The housing and storing of equestrian paraphernalia presents certain problems with respect to supporting and storing the same when not in use. This pertains to such items as saddles, stirrups and straps, saddle pads, boots, leather dressing, and various other accouterments normally used in regard to equestrian activity. Frequently, a saddle is simply thrown over the upper edge of a stall divider, or in some circumstances, even a fence rail. Especially in regard to modern expensive saddles and the like, however, and particularly where saddles and related elements are not housed in a stable or the like, it is desirable to provide certain types of racks or boxes to support the same and contain them when not in use. Various developments have been made heretofore for purposes of supporting or storing saddles and the like under certain circumstances. For example, prior U.S. Pat. No. 2,809,755 to Martorello, dated Oct. 15, 1957, discloses a closet arrangement formed in the forward end of a horse trailer for purposes of containing a saddle. Also, especially for use in stables, suitable racks have been developed heretofore such as those disclosed in prior U.S. Pat. No. 3,688,912, to Wilmoth, dated Sept. 5, 1972 and U.S. Pat. No. 3,780,971 to De Filipps, dated Dec. 25, 1973, in which metal racks are illustrated of the type that are adapted to be secured to a vertical wall in a barn or stable and extend horizontally therefrom to receive a saddle with the stirrups draped from opposite sides.

The present invention has been devised for ready portable use and comprises a box-like structure having supporting rails described in greater detail hereinafter. In some respects, the preferred embodiment of the invention somewhat resembles a carpenter's or mechanic's toolbox, one example of which is shown in U.S. Pat. No. 4,122,944 to De Napoli, dated Oct. 31, 1978, which is simply a rectangular box having a single elongated handle rail extending above a closed top. Also, it is old to provide combination sawhorses and tool chests in which it might be considered that the top rail of the sawhorse might be a suitable support for a saddle. Combination sawhorses and tool chests are illustrated in certain prior U.S. patents, such as U.S. Pat. No. 1,404,266 to Brouner, dated Jan. 24, 1922, and U.S. Pat. No. 2,727,543 to Polselli, dated Dec. 20, 1955.

Still another holder and kit of interest is found in U.S. Pat. No. 2,592,212 to Turner, dated Apr. 8, 1952, and comprising a nursing bottle holder in which a central rail extends between end members of a box-like arrangement for purposes of supporting a nursing bottle.

While the art referred to above is representative of a number of different types of box-like supports and containers for a number of different items, the present invention has been designed particularly to support equestrian equipment, such as saddles, bridles, boots, and similar leather accouterments, as well as leather dressing materials and otherwise, and includes features not found in the prior art in the same relationship and for certain novel purposes, details of which are set forth below.

SUMMARY OF THE INVENTION

It is among the principal objects of the present invention to provide a tack box and saddle rack unit in which a generally rectangular box of convenient size is provided with parallel upstanding ends which extend above the upper edges of the side panels a distance preferably greater than twice the height of the side panels in order that a central upper rail may be mounted between the uppermost portions of the end members to comprise the principal supporting member for a saddle and a pair of side rails respectively are mounted between said end member adjacent but spaced a short distance inward from the opposite side edges of the end members and at a distance above the upper edges of the side panels preferably substantially equal to the height of the side panels in order to provide ample space for access of depending stirrup straps and stirrups, as well as the sides of a saddle pad to be stowed inside the side panels of the box, and thereby provide effective means for supporting the saddle in horizontal position, and all hanging members being included within the box.

It is another object of the invention to preferably form the unit attractively from wooden boards and wooden dowels to form the rails, whereby construction of the unit may be accomplished quickly and with minimum labor in order to provide a unit of aesthetic properties, coupled with durability and utilitarian purposes.

Details of the foregoing objects and of the invention, as well as other objects thereof, are set forth in the following specification and illustrated in the accompanying drawings comprising a part thereof.

DETAILED DESCRIPTION OF THE PREFERRED EMBODIMENTS

Figure 1:
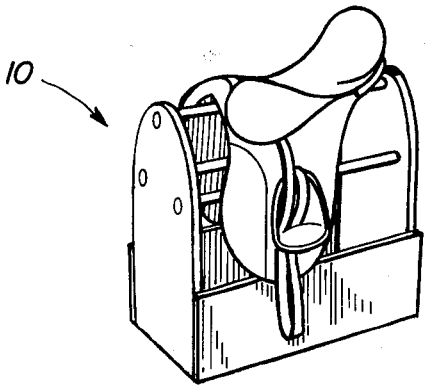
FIG. 1 is a perspective view of a tack box and saddle rack unit embodying the principles of the present invention and showing one exemplary disposition of a saddle and other equestrian paraphernalia supported thereon.
Figure 2:
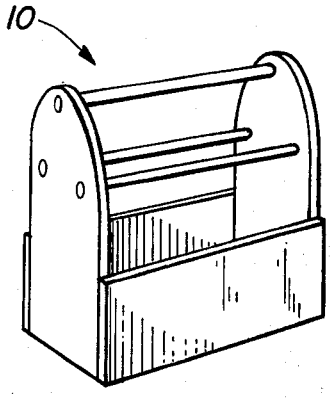
FIG. 2 is a perspective view similar to FIG. 1, but showing the unit with no items mounted thereon.

Referring particularly to FIGS. 1 and 2, it will be seen that tack box and saddle rack unit constituting the present invention comprises a generally rectangular box 10, which actually forms the bottom or base of the unit and includes a pair of side panels 12 and 14 and a bottom 16. Preferably, and conveniently, all elements of the unit may be formed from wooden boards for ease of construction and ready availability of material. The opposite ends of the side panels and bottom are nailed or otherwise affixed to the lower portions of a pair of similar end members 18 and 20, one embodiment of which is shown in FIG. 5, and the second embodiment is shown in FIG. 6, the principal difference being the configuration of the upper portions of the end members 18 and 20, especially for aesthetic purposes.

Without restriction thereto, but for purposes of affording convenient dimensions for the unit, it has been found that having the box approximately two feet long and the end members 18 and 20 two feet high, ample supporting and storage space is afforded for a reasonable amount of equestrian equipment, including an adult-size saddle, but especially of the English type without a horn, as illustrated in exemplary manner in FIG. 1. By way of further exemplary dimensions which have been found to be highly useful, the end members 18 and 20 are approximately eleven inches wide and the height of the side panels 12 and 14 is approximately ten inches, all members of the unit being formed from wooden boards approximately three-fourth inch in thickness.

Figure 3:
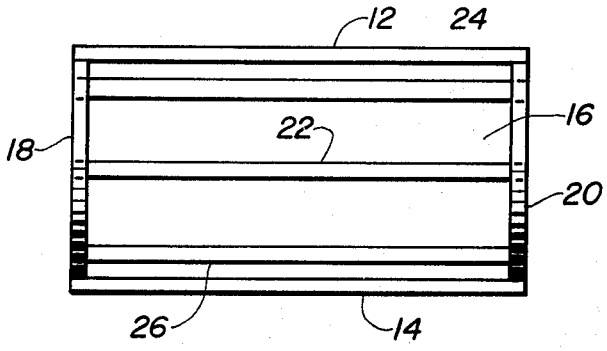
FIG. 3 is a top plan view of the unit shown in FIGS. 1 and 2.
Figure 5:
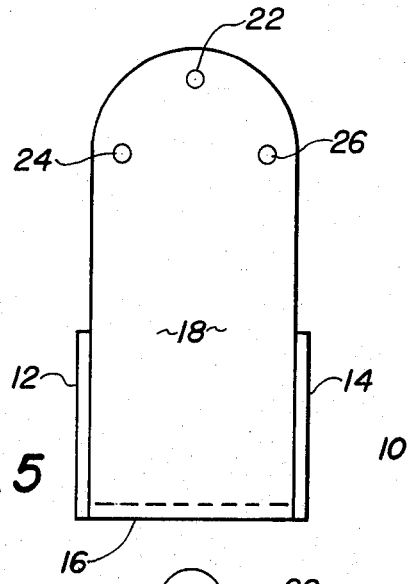
FIG. 5 is a vertical end view of one embodiment of the unit shown on the preceding figures.
Figure 4:
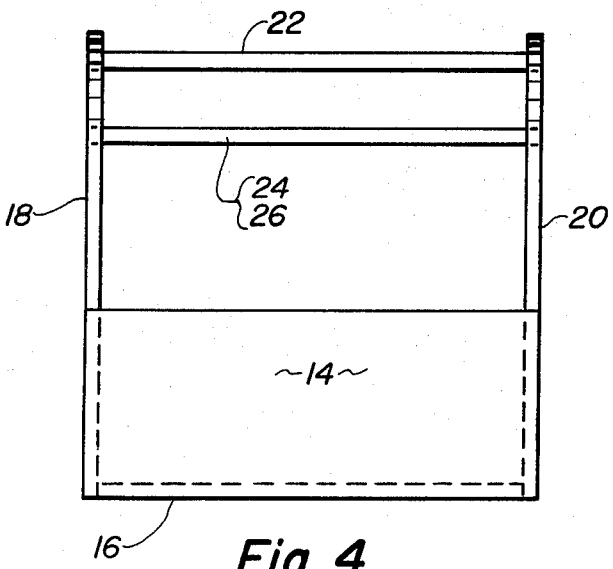
FIG. 4 is a vertical side elevation of the unit shown in FIGS. 1–3.
Figure 6:
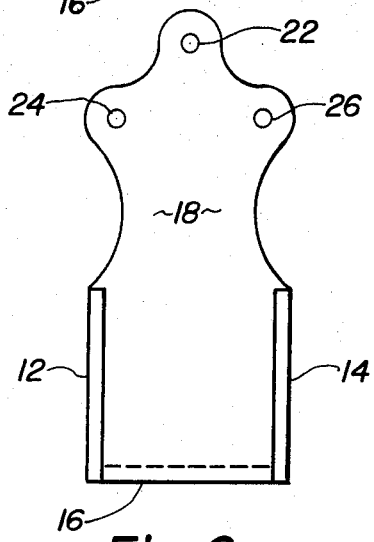
FIG. 6 is an end view of another embodiment of configuration of the end members of the units shown in the preceding figure.

Of particular importance in the present invention is the provision of supporting rails of which, preferably, three are utilized and respectively arranged somewhat in triangular configuration as illustrated in exemplary manner in FIGS. 5 and 6. Of these rails, uppermost central rail 22 is preferably disposed midway between the opposite side edges of the end members 18 and 20 and adjacent the upper end thereof, whereby it is very substantially spaced above the upper edges of the side panels 12 and 14. In addition, the pair of side rails 24 and 26 are positioned within a common horizontal plane spaced above the upper edges of the side panels 12 and 14 a distance approximately equal to the height of said side panels for purposes of affording ample clearance between said rails and the upper edges of said side panels for purposes of facilitating the stowing of depending stirrup straps and stirrups, as well as saddle pads and/or leather side panels of the saddles, all of which are preferably stowed within the confines afforded by the side panels 12 and 14, rather than extending thereover, especially for neatness and compactness. Further, it will be seen especially from FIG. 3, as well as FIG. 5, that the side panels 24 and 26 are spaced a short distance inwardly from the opposite edges of the end members 18 and 20 but ample space is provided between said side rails so that the triangular arrangement of the uppermost central rail 22 and side rails 24 and 26 are such as to afford supporting means for a saddle in a manner to hold the same horizontally and minimize the possibility of the saddle tending to slide to one side or the other, especially in view of the fact that the depending members from the saddle are all stowed within the area defined by the side panels 12 and 14.

From the foregoing, it will be seen that the present invention provides supporting and storage units for equestrian equipment, including not only a saddle with stirrups and saddle pad, but also boots, bridle and other similar equipment and paraphernalia used in the sport of horseback riding, as well as appropriate oils, soaps, and the like, used incident to preserving leather, and grooming equipment for a horse, such as a curry comb, brush and the like, all of which is conveniently held within the space defined by the side panels 12 and 14, as well as the end members 18 and 20.

The rails 22, 24 and 26 very conveniently may be formed from wooden dowel material of approximately one inch in diameter, which is fully capable of sustaining the weight of saddles and other equipment supported thereby. Further, the uppermost rail in particular, as well as, under some circumstances, the side rails 24 and 26, may be used to transport the unit, even when containing the equipment, as illustrated in FIG. 1, particularly when free of such equipment, as shown in FIG. 2.

The foregoing description illustrates preferred embodiments of the invention. However, concepts employed may, based upon such description, be employed in other embodiments without departing from the scope of the invention. Accordingly, the following claims are intended to protect the invention broadly, as well as in the specific forms shown herein.

I claim:

1. A tack box and saddle rack unit comprising in combination, a generally rectangular box including a lower portion having parallel side panels of equal height and a unitary bottom panel, the opposite ends of which are secured respectively to the opposite side and bottom edges of the lower portion of parallel vertical end members having upper portions which extend a substantial distance above the upper edges of said side panels comprising the lower portion of the box, an uppermost rail extending between the uppermost portions of said end members centrally thereof in the upper portion of the box to support a saddle, and a pair of side rails respectively extending between the upper portions of said end members within a common horizontal plane above the upper edges of said side panels a distance substantially equal to the height of said side panels in a somewhat triangular arrangement with said uppermost rail and respectively being spaced a short distance inward from the outer edges of said end members and within vertical planes parallel to but spaced inward from the inner surfaces of said side panels of the lower portion of said box and operable to have stirrup straps and other depending side members of a saddle draped along the outer surfaces of said side rails for disposition of stirrups and other accouterments within the box of the unit, said upper portions of said end members extending above the lower portion of the box defined by the upper edges of said side members a distance greater than the height thereof and said central uppermost rail being above said pair of side rails, whereby all of said rails are in the upper portion of said box above the lower portion thereof.

* * * * *